US006264040B1

(12) United States Patent
Mankosa et al.

(10) Patent No.: US 6,264,040 B1
(45) Date of Patent: Jul. 24, 2001

(54) HINDERED-BED SEPARATOR DEVICE AND METHOD

(76) Inventors: Michael J. Mankosa, 5116 Kates Way, Erie, PA (US) 16509; Gerald H. Luttrell, 1907 Shadow Lake Rd., Blacksburg, VA (US) 24060

( * ) Notice: Subject to any disclaimer, the term of this patent is extended or adjusted under 35 U.S.C. 154(b) by 0 days.

(21) Appl. No.: 09/453,680

(22) Filed: Dec. 3, 1999

Related U.S. Application Data

(60) Provisional application No. 60/111,063, filed on Dec. 4, 1998.

(51) Int. Cl.[7] ..... B03B 5/66

(52) U.S. Cl. ..... 209/158; 209/155; 209/172; 209/172.5; 209/173

(58) Field of Search ..... 209/155, 158, 209/172, 172.5, 173

(56) References Cited

U.S. PATENT DOCUMENTS 4,533,464 * 8/1985 Smith et al. ..... 209/158

4,807,761 * 2/1989 Hollingsworth ..... 209/158

* cited by examiner

*Primary Examiner*—Donald P. Walsh
*Assistant Examiner*—Mark J. Beauchaine
(74) *Attorney, Agent, or Firm*—Lovercheck & Lovercheck PC

(57) ABSTRACT

A process and a structure is described for separating particles in a fluid medium based on a difference in settling velocity. The feed is introduced tangential into the separation zone. The tangential feed system includes a transition box to reduce flow velocity and disperse the slurry across the separator eliminating the efficiency losses associated with other classifiers that introduce feed directly into the separation chamber. This approach offers an improvement in process capacity and efficiency. The fluidization water is introduced to the separation chamber below a baffle plate that disperses the water across the base of the separator. The feed system may include baffles in the upper separation chamber, and a stilling well with an impact plate adjustable side walls and adjustable baffle plates to reduce flow velocity and disperse the slurry across the separator.

30 Claims, 4 Drawing Sheets

HINDERED-BED SEPARATOR DEVICE AND METHOD

CROSS REFERENCE TO RELATED APPLICATIONS

This application claims the benefit of U.S. Provisional application Ser. No. 60/111,063 filed Dec. 4, 1998.

STATEMENT REGARDING FEDERALLY SPONSORED RESEARCH OR DEVELOPMENT

Not applicable

FIELD OF THE INVENTION

The invention relates to the use of a separator to partition a particulate assemblage into various constituents based on a difference in the settling velocity of particles having similar or different densities in a fluid medium.

BACKGROUND OF THE INVENTION

Hydraulic classification devices are used extensively throughout the minerals industry to produce differently sized products from a particulate assemblage consisting of a full distribution of particle sizes. Although numerous devices have been developed over the years, a technique currently popular is hindered/fluidized-bed separators. These devices work well for mineral classification if the particle size and density ranges are within acceptable limits.

A great deal of research has been devoted to the study of fluidized-beds and their use in gas/solid contacting and in liquid/solid applications. Studies describing the latter having typically focused on the classification aspects of fluidized-bed separators, although recent work has shown that these devices can also be effectively used for mineral concentration. A hindered-bed separator is a vessel in which water is evenly introduced across the base of the device and rises upward. The separator typically has an aspect ratio of two or more and is equipped with a means of discharging faster settling solids through the bottom of the unit. Rising water and light solids flow over the top of the separator and are collected in a launder. Solids are introduced in the upper portion of the vessel and begin to settle at a rate defined by the particle size and density. The coarser solids settle at a rate that exceeds that of the rising water. A restricted orifice in the base of the separator regulates the discharge of the coarse solids. As a result, a teetering, high-density bed of particles is maintained within the separator. The small interstices within the teeter bed create high interstitial liquid velocities that resist penetration of the finer particles. The fines, therefore, are maintained in the upper portion of the separator and discharge over the top into a collection launder.

It is obvious from the above description that quiescent flow conditions must exist within the separator to maintain a high efficiency. Excessive turbulence and/or changes in flow conditions can result in misplacement of particles. Unfortunately, current teeter-bed separators utilize a feed injection system that discharges directly into the main separation chamber. These systems typically consist of a vertical pipe that terminates approximately one-third of the way into the main separator body. The pipe discharge is usually equipped with a dispersion plate to laterally direct the feed slurry (a mixture of solids and water). This approach creates turbulence within the separator. Additionally, the water that is injected with the feed must also report to the overflow launder. As a result, the rise velocity of the water is substantially increased at the feed injection point. Above the feed point, the liquid rise velocity is the sum of the teeter water and the feed water. This discontinuity often results in a second teeter interface within the separator. In fact, at higher feed rates the volume of water associated with the feed slurry is greater than the volume of teeter water; thus severely affecting unit performance.

Maintenance and reliability are also crucial to long-term separator performance. Conventional teeter-bed separators use a series of lateral pipes located in the base of the separation zone. These pipes are perforated at regular intervals with small diameter holes. Teeter water is injected through these numerous holes over the entire cross-section of the separator. The large water flow rates and small injection hole diameter leave the device susceptible to frequency blockage and plugging due to contaminates in the process water. When several orifices become blocked a dead zone occurs in the fluidization chamber resulting in a loss of performance in this area. It can be seen, therefore, that the conventional hindered-bed separator has inherent design features that limit the capacity and efficiency of the separator. Design modifications are presented that have been demonstrated to provide a higher unit capacity and minimize maintenance aspects of the separator.

SUMMARY OF THE INVENTION

From the discussion presented above, it is apparent that modifications should be incorporated into new devices to correct the inefficiencies associated with conventional hindered-bed separators. Typically, the feed slurry composition cannot be modified. Likewise, it is difficult and expensive to pre-treat the process (teeter) water to remove contaminants. Therefore, a different approach must be considered. Modification of the separator is needed to overcome existing deficiencies. Various approaches have been evaluated such as introducing the feed and teeter-water tangentially into a cylindrical tank.

One of the distinctive features of the present invention is the feed introduction system. A feed delivery device has been developed that minimizes the flow velocity and gently disperses the feed slurry across the top of the separator. As previously stated, the velocity of the feed slurry as it enters the separator significantly impacts performance. Therefore, it is desirable to minimize the feed velocity. This is achieved by providing a feed transition box and a tangential feed introducer. The transition box redirects the feed slurry over a larger cross-sectional area. It is well known that the product of the flow velocity and cross-sectional area represents volumetric flow. It is obvious, therefore, that increasing the cross-sectional area will reduce the flow velocity. In the feed transition box, the flow area is increased to the full width of the separator. As such, the slurry velocity is minimized.

A second feature of the invention is a tangential feed introducer. The feed introducer is located at the top of the separator and provides a smooth conveyance of the slurry from the transition box to the separator. The J-shaped introducer has a horizontal approach allowing the feed slurry to travel across the top of the separator to the overflow launder. As a result, performance is not affected since the teeter water velocity remains constant throughout the separation chamber. A baffle plate is also located at the discharge end of the feed introducer to prevent short-circuiting of solids directly to the overflow launder.

The cross-flowing concept has been tried before using short, horizontal tanks. These earlier systems, however, did not incorporate adequate water introduction and underflow discharge systems. As a result, they behaved as free-settling separators rather than hindered-bed devices. It is important to recognize the fundamental difference between free- and hindered-settling conditions. Hydraulic classifiers fall into one of two categories; free settling or hindered settling. Under free settling conditions, individual particles do not affect the settling behavior of adjacent particles and, as such, the pulp has the rheological characteristic of the fluid. Furthermore, the settling velocity is determined by particle size and density as dictated by Stokes' law. These devices typically require more elutriation water, have a lower unit capacity and are less efficient.

Hindered settling is fundamentally different. At high solids concentrations, adjacent particles collide with each other influencing the settling characteristics. The settling path is greatly obstructed reducing particle velocity. Additionally, the high solids concentration increases the apparent viscosity and specific gravity of the pulp, thus further reducing particle settling. As a result, the acceleration of particles becomes more important than the terminal velocity. This collision phenomenon is the most important aspect of hindered settling and provides a degree of efficiency that can not be achieved in a free-settling environment.

Another advantage of the invention is the teeter water introduction system. A novel approach has been developed that incorporates a baffle plate to disperse the teeter water across the base of the separator. A horizontal, slotted plate is located at the base of the separation chamber. Water is introduced beneath the plate through a series of large diameter holes (>½ inch). Unlike existing separators, however, these orifices are located at distant intervals (typically >6 inches) and serve simply to introduce the water. Dispersion is achieved by means of the baffle plate.

This combined approach of a cross-flowing, hindered-bed separator that incorporates a novel water introduction system provides a synergy that has not been previously achieved. This device achieves a high unit capacity and eliminates mechanical problems associated with existing designs.

The desired hydrodynamic conditions for introduction of material into the teeter-bed separator can be accomplished by a number of mechanical configurations. These include, but are not limited to, various design configurations that permit the feed slurry to enter on the top of the separation chamber in a quiescent, laminar approach.

Typical alternate design configurations for a square or rectangular hindered-bed separator may be described as a two-sided feed introduction system and as a single-sided design. In this configuration, feed material enters the stilling well of the feed assembly by pumping and/or gravity flow. The stilling well breaks the feed velocity and de-aerates the in-coming feed material. The stilling well may be equipped with adjustable side plates to control the slurry discharge height.

The feed material is directed to the baffle chamber by the impact plate. The baffle chamber serves two functions: 1) to distribute flow to the separator chamber and 2) to reduce turbulence prior to introduction to the separation chamber. The baffle chamber may be equipped with adjustable discharge gates to regulate flow into the separation chamber. It should be noted that all wetted surfaces may incorporate a rubber lining to minimize wear. It should be noted that this same approach can be incorporated into a circular tank design using a round feed box assembly.

To further improve the capacity and efficiency of hindered-bed separators, an internal baffle system has also been included in this design. A number of vertical, adjustable baffles may be used in the separation chamber. The vertical baffles serve several distinct purposes in the separation chamber including, but not limited to: 1) minimizing short-circuiting of material, 2) reducing turbulence, and 3) improving internal concentration gradients. The baffles can be positioned in various locations through the tank depending on the requirements for a specific application. Additionally, the baffles can be positioned completely beneath the liquid surface and/or partially exposed above the liquid surface. The baffles are constructed of, but not limited to, solid plates and/or perforated surfaces. The number, position and type of baffles will vary depending on the intended use of the hindered-bed separator.

It is an object of the present invention to provide a cross-flowing hindered-bed separator with slurry introduction and transition structure adjacent the top of the separator.

It is another object of the present invention to provide a slurry feed introduction system that reduces flow velocity across the entire cross-sectional area of the separator whereby flow velocity is minimized.

It is another object of the present invention to provide a smooth conveyance of the slurry from the transition box to the separator.

It is another object of the present invention to prevent flow of solids directly to the overflow launder.

It is another object of the present invention to introduce teeter water below a baffle plate which will dispense teeter water across the base of the separator providing a uniform upward flow.

It is another object of the present invention to provide a hindered-bed separator device and method that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
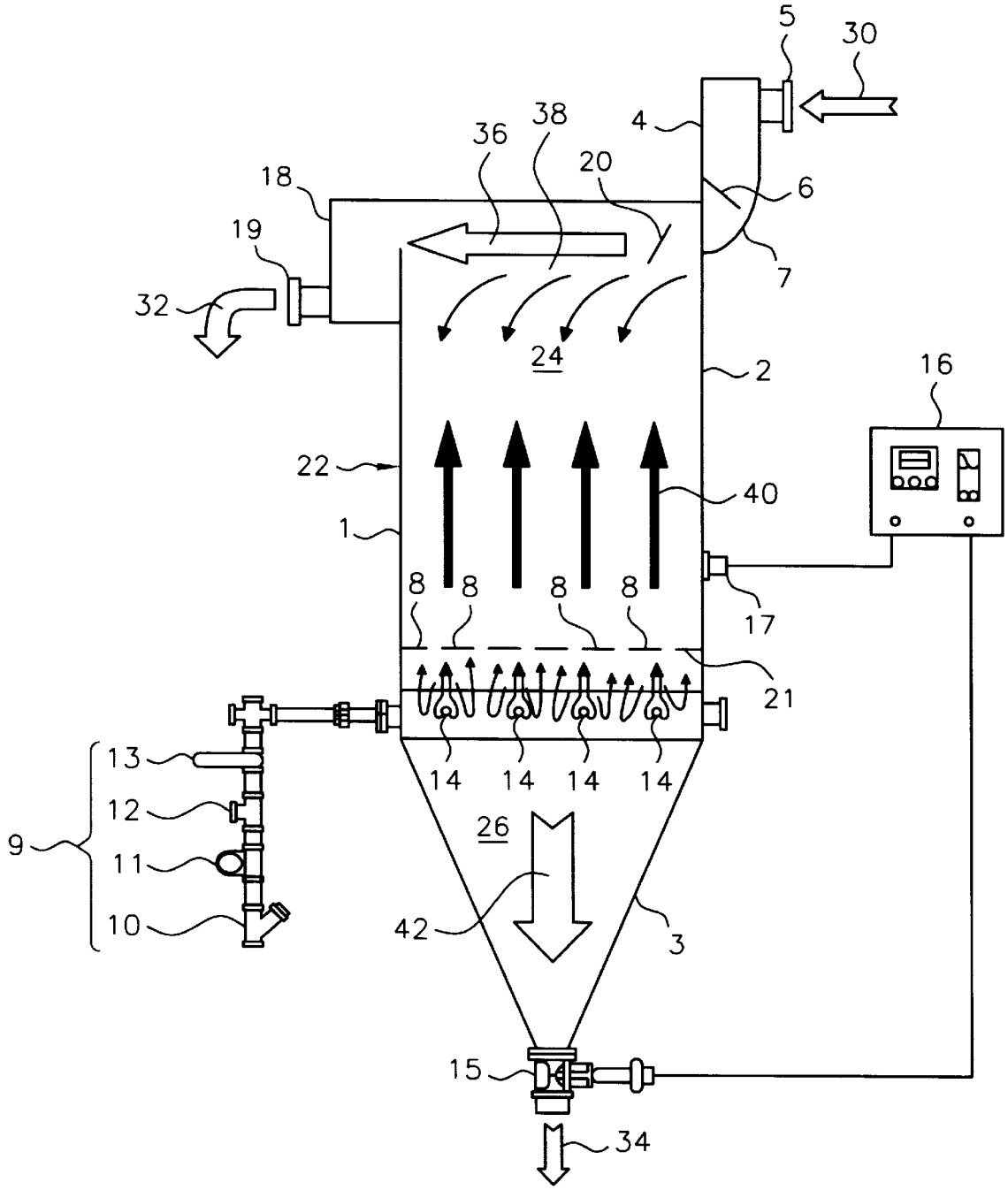
FIG. 1 is a side view of the cross-flowing, hindered-bed separator with slurry introduction adjacent the top and teeter water introduced below a dispersing baffle plate across the base of the separator according to the invention.

A schematic diagram illustrating the invention is shown in FIG. 1. Separator 22 consists of main housing 1 forming an enclosed chamber which consists of upper separation body 2 and lower dewatering cone 3. The enclosed chamber contains the particulates to be separated. Slurry is introduced as indicated at arrow 30 into feed transition box 4 through inlet flange 5. The velocity head of the slurry is redirected and the material dispersed over the cross-section of upper separator body 2 by feed transition box 4. Feed transition box 4 is equipped with adjustable throttling gate 6 to regulate the slurry flow and ensure complete distribution of slurry across upper separation body 2. Feed transition box 4 redirects the flow pattern across the top of upper separation body 2 by means of tangential introducer 7.

Teeter water enters the system through flow control manifold 9 that consists of strainer 10, flow meter 11, check valve 12 and flow regulating valve 13. Teeter water entering the system discharges through injection pipes 14 located in the base of upper separation body 2 beneath water dispersion plate 21. The teetering bed of solids is maintained by automatic underflow discharge valve 15 that is actuated by process controller 16 based on an input signal from pressure sensor 17. Upper separator body 2 contains upper portion 24 of the teetering bed of solids. Lower dewatering cone 3 contains lower portion 26 of the teetering bed of solids.

The method of the invention consists of particles entering separator 22 as indicated at arrow 30 through feed transition box 4 and traveling laterally across the top of upper separation body 2, and then traveling downwardly as indicated at arrows 38. Baffle plate 20 is used to dampen turbulence on the surface of separator 22 and to prevent short circuiting of separator 22, the path being indicated by arrow 36, crossing direct to overflow launder 18. The coarse solids begin to settle downward into the separation chamber against the flow of the rising teeter water introduced by injection pipes 14. A fluidized bed is established by the upward rise of water 40. The finer particles cannot penetrate the teetering bed of coarse solids and are carried to overflow launder 18 and exit, as indicated at arrow 32, by means of launder discharge outlet 19. The coarse particles migrate toward the bottom of the separation chamber, as indicated at arrow 42, and exist at the apex of dewatering cone 3.

The coarse solids are discharged, as indicated at arrow 34, through control valve 15 that is actuated by process controller 16. Process controller 16 output is proportional at an input signal derived from pressure sensor 17 located on the side of the separation chamber. If the height of the teetering bed of solids increases, the output signal from pressure sensor 17 shows a corresponding increase. Likewise, the sensor output signal will decrease with a decrease in teeter bed height.

Teeter water enters injection sites 8 at the base of upper separation body 2 through injection pipes 14. Injection pipes 14 serve simply to introduce water to separator 22. Distribution of the water throughout the cross-section of the device is accomplished by means of dispersion plate 21. The teeter water is initially directed downward by injection pipes 14 into the coarse particle bed in dewatering cone 3. The particles assist with dispersion of the water as it reverses direction toward the top of separator 22. The rising water then encounters dispersion plate 21. Dispersion plate 21 occupies a significant proportion of the cell cross-sectional area. As a result, the water accelerates through the plate open area. The acceleration creates localized turbulence that further distributes the teeter water across the base of the cell.

The desired hydrodynamic conditions for introduction of material into the teeter-bed separator can be accomplished by a number of mechanical configurations. These include, but are not limited to, various design configurations that permit the feed slurry to enter on the top of the separation chamber in a quiescent, laminar approach.

Figure 2:
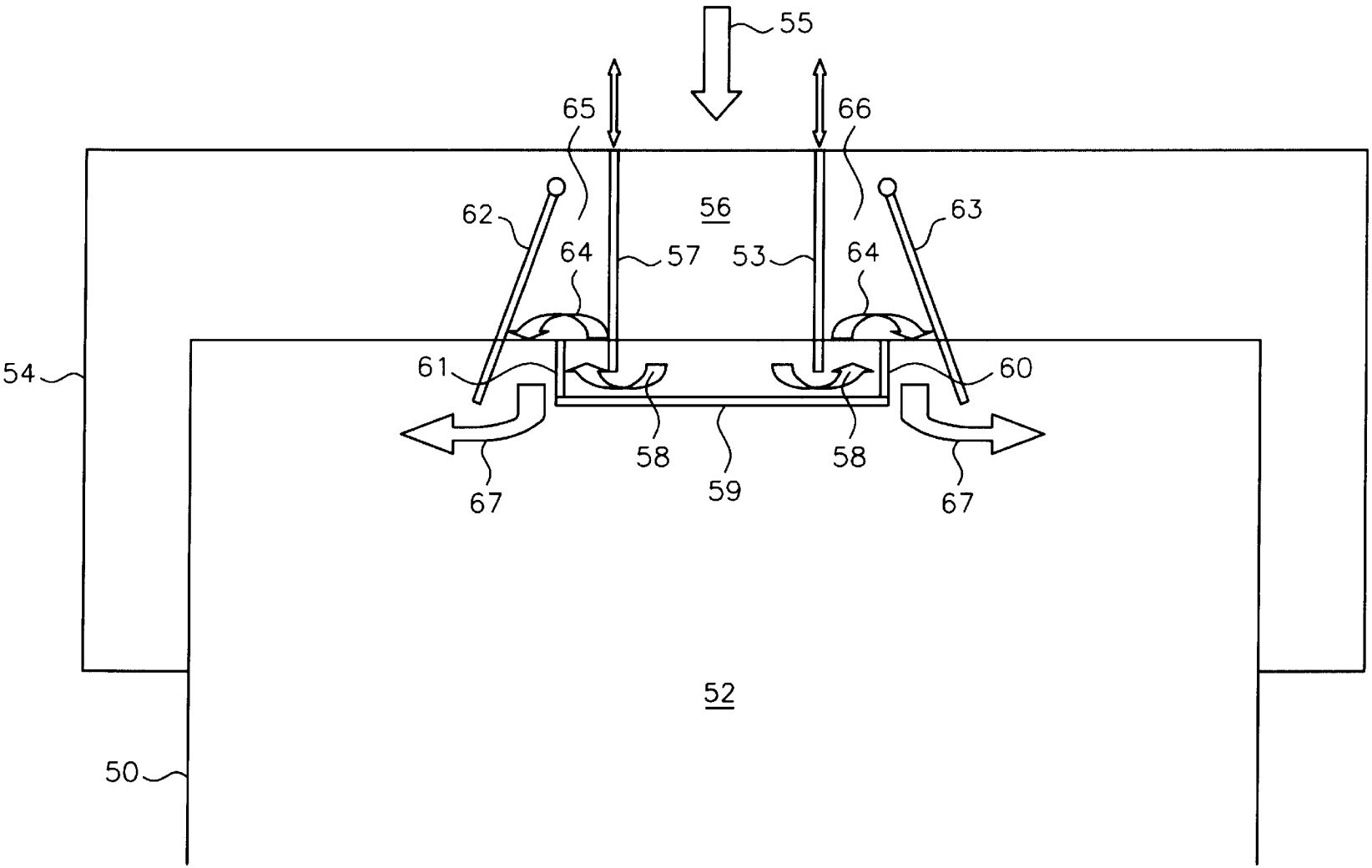
FIG. 2 is an alternate embodiment of a two-sided feed introduction system for a square or rectangular hindered-bed separator according to the invention.
Figure 3:
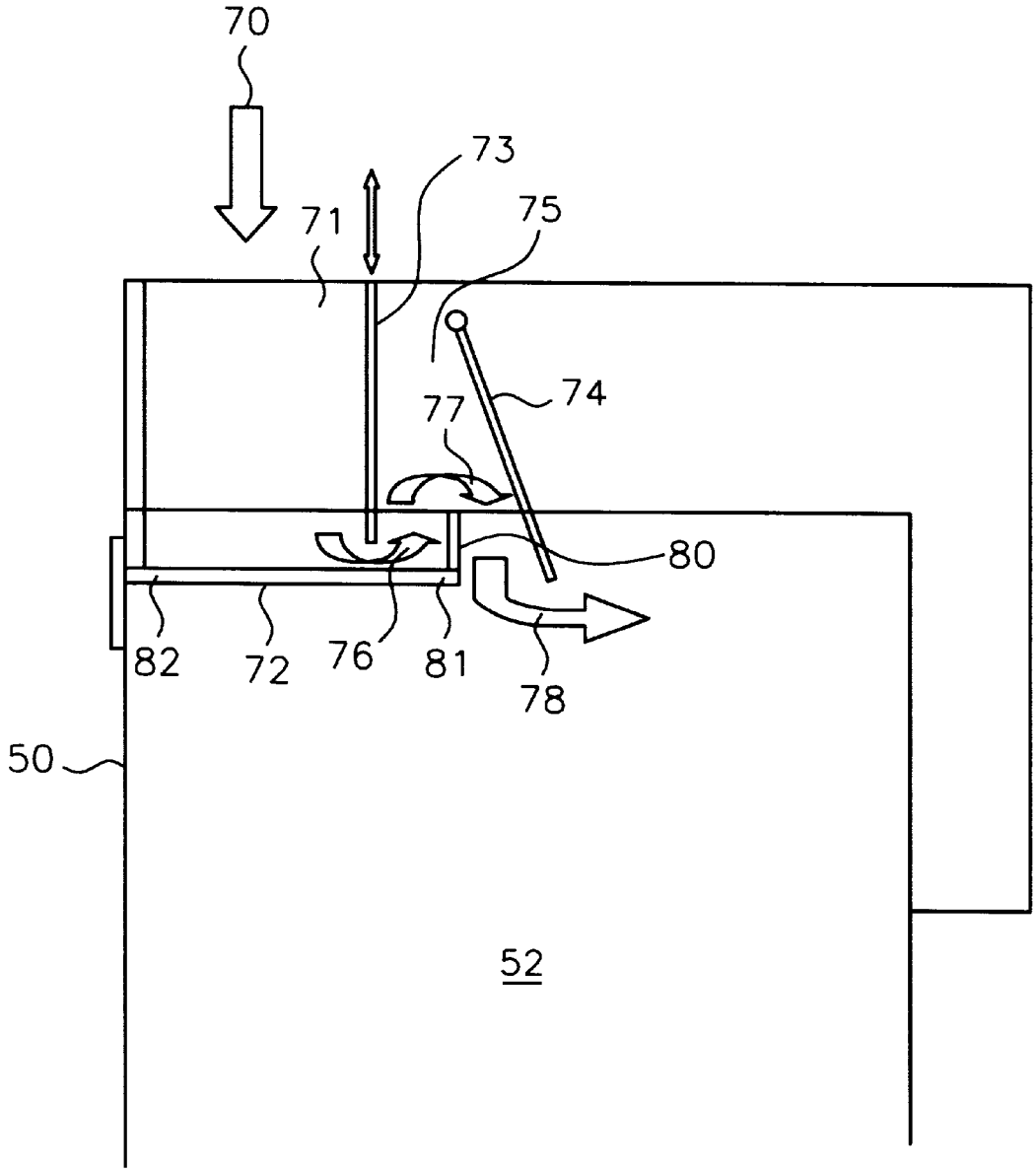
FIG. 3 is a single sided feed introduction system according to the embodiment of FIG. 2 for square or rectangular hindered-bed separators.

A typical alternate design configuration for a square or rectangular hindered-bed separator is shown in FIGS. 2 and 3. In this instance, FIG. 2 shows a two-sided feed introduction system while FIG. 3 illustrates a single-sided design.

In the configuration shown in FIG. 2, square or rectangular separator 50 has main separation chamber 52 and overflow launder 54 at the upper end of main separation chamber 52. Slurry path 55 enters from above main separation chamber 52 into stilling well 56. Stilling well 56 has adjustable side walls 57 and 53 that are adjustable upwardly and downwardly to regulate the slurry flow thereunder at position 58 as the slurry exits from stilling well 56. The bottom of stilling well 56 is formed by impact plate 59 and short side walls 60,61, which move the slurry flow upwardly at position 64. Outboard of short side walls 60,61 are adjustable baffle plates which direct the slurry flow downwardly and outwardly at position 67 into main separation chamber 52. Feed material enters the stilling well of the feed assembly by pumping and/or gravity flow. Stilling well 56 breaks the feed velocity and de-aerates the in-coming feed material.

The feed material is directed to baffle chambers 65,66 by impact plate 59. Baffle chambers 65,66 are formed by adjustable side walls 53,57 and adjustable baffle plates 62,63. Baffle chambers 65,66 serve two functions: 1) to distribute flow to the separator chamber and 2) to reduce turbulence prior to introduction to the separation chamber. Baffle chambers 65,66 may be equipped with adjustable discharge gates to regulate flow into the separation chamber. It should be noted that all wetted surfaces may incorporate a rubber lining to minimize wear. It should be noted that this same approach can be incorporated into a circular tank design using a round feed box assembly.

As shown in FIG. 3, a square or rectangular separator having main separator chamber 52 may be provided with a single sided transition chamber having slurry path 70 entering the top of stilling well 71 which generally occupies the space above impact plate 72 which extends generally along the length of a side of separator 50. One or more adjustable side walls 73 are adjustable upwardly and downwardly to regulate the slurry flow out of stilling well 71. One or more adjustable baffle plate 74 extends generally coextensively with and parallel to side walls 73. Side walls 73 and baffle plates 74 form baffle chamber 75 therebetween. Short flange 80 is attached to inner end 81 of impact plate 72. Impact plate 72 is attached at outer end 82 to the side of separator 50. The slurry flow follows slurry path 70 entering the top of stilling well 71 passes under adjustable side walls 73 at position 76, at position 77 slurry flow passes over short flange 80 and at position 78 slurry flow passes downwardly and outwardly under baffle plates 74.

Figure 4:
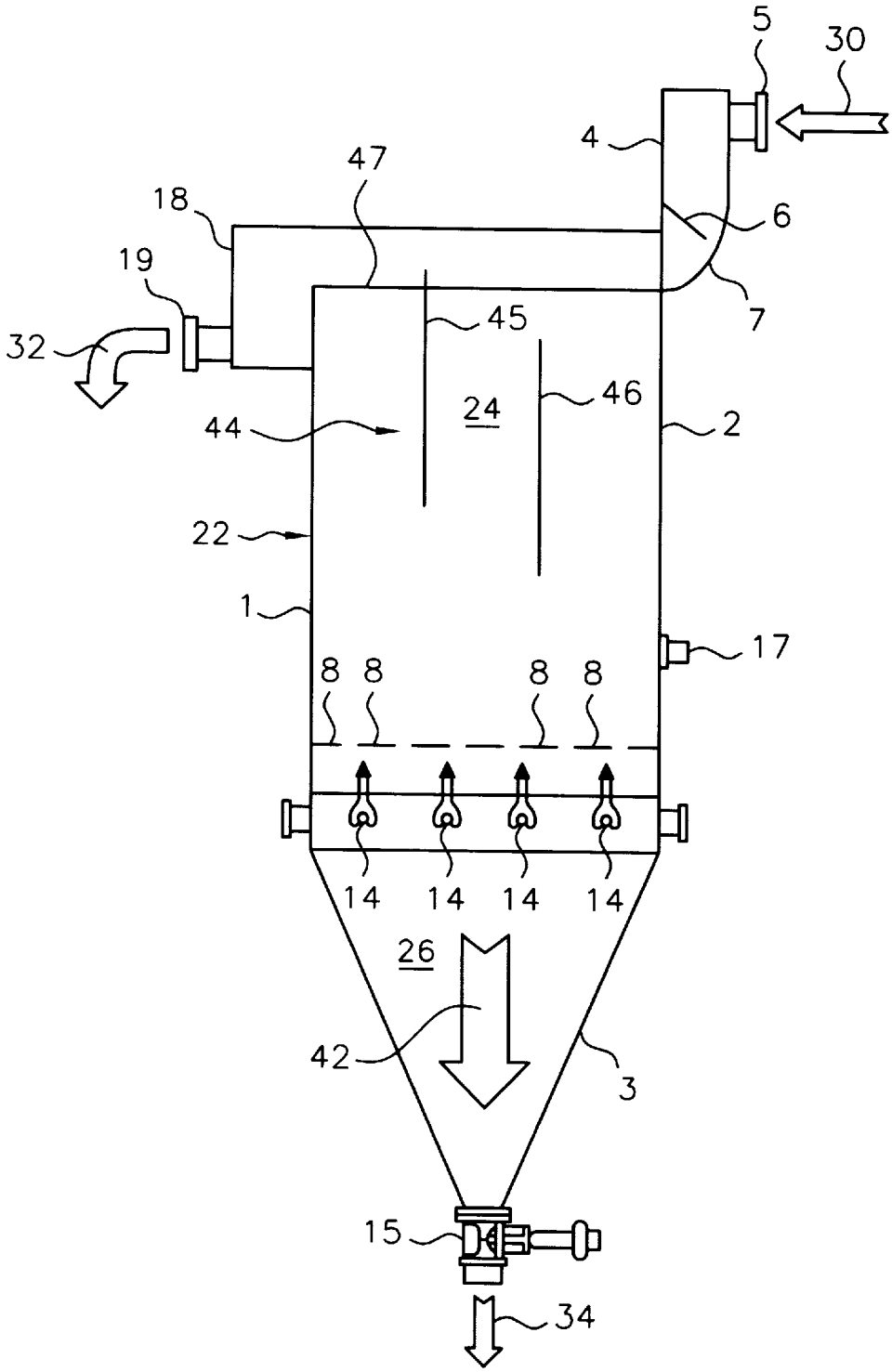
FIG. 4 is a hindered-bed separator having an internal baffle system.

As shown in FIG. 4, the capacity and efficiency of hindered-bed separators may be improved with the addition of internal baffle system 44 to upper separation body 2 generally disposed below the level of tangential introducer 7 and liquid level 47. A number of vertical, adjustable baffles may be used in the separation chamber. In FIG. 2, vertical baffles 45 and 46 are shown. Vertical baffles 45,46 serve several distinct purposes in upper separation body 2 including, but not limited to: 1) minimizing short-circuiting of material, 2) reducing turbulence, and 3) improving internal concentration gradients. Vertical baffles 45,46 can be positioned in various locations through upper separation body 2 depending on the requirements for a specific application. Additionally, vertical baffles 45,46 can be positioned completely beneath liquid surface 47 and/or partially exposed above the liquid surface 47. Vertical baffles 45,46 are constructed of, but not limited to, solid plates and/or perforated surfaces. The number, position and type of baffles will vary depending on the intended use of the hindered-bed separator.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A cross-flowing hindered-bed separator comprising: a separator body having a top end and a bottom end and enclosing an upper portion and a lower portion;

a slurry feed transition box adjacent said top end of said separator body;

a tangential feed introducer between said transition box and said separator body; and, an overflow launder adjacent said top end of said separator body;

a baffle in said upper portion of said top end of said separation body.

2. The separator recited in claim 1 further comprising an adjustable throttling gate positioned in said transition box.

3. The separator recited in claim 1 wherein said baffle plate is positioned between said tangential feed introducer and said overflow launder directing entering slurry away from said overflow launder.

4. The separator recited in claim 1 further comprising a dispersion plate extending generally across said separator body between said upper portion and said lower portion; and, said dispersion plate having spaced holes therethrough.

5. The separator recited in claim 4 further comprising means to introduce teeter water into said separator body supported below said dispersion plate; and, said dispersion plate distributes said teeter water across said separator body as said teeter water moves upwardly.

6. The separator recited in claim 1 further comprising injectors below said dispersion plate which inject said teeter water into said separator body.

7. The separator recited in claim 6 wherein said injectors direct said teeter water generally downwardly.

8. The separator recited in claim 1 further comprising more than one baffle in the upper separation chamber.

9. The separator recited in claim 1 further comprising a baffle plate positioned between said feed introducer and said overflow launder directing entering slurry away from said overflow launder.

10. The separator recited in claim 1 further comprises an adjustable distribution plate in said transition box.

11. A cross-flowing hindered-bed separator comprising:

a separator body having a top end and a bottom end enclosing an upper portion and a lower portion;

a dispersion plate extending generally across said separator body between said upper portion and said lower portion;

said dispersion plate having spaced holes therethrough;

teeter water entering said separator body below said dispersion plate; and, said dispersion plate distributes said teeter water across said separator body as said teeter water moves upwardly;

an overflow launder adjacent said top end of said separator body;

a baffle plate positioned between said tangential feed introducer and said overflow launder.

12. The separator recited in claim 11 further comprising injectors below said dispersion plate which inject said teeter water into said separator body.

13. The separator recited in claim 12 wherein said injectors direct said teeter water generally downwardly.

14. The separator recited in claim 11 further comprising a slurry feed transition box adjacent said top end of said separator body.

15. The separator recited in claim 14 further comprising an adjustable throttling gate positioned in said transition box.

16. The separator recited in claim 14 further comprising an adjustable distribution plate in said transition box.

17. The separator recited in claim 11 further comprising a feed introducer between said transition box and said separator body.

18. The separator recited in claim 11 wherein more than one of said baffle plates are positioned between said tangential feed introducer and said overflow launder.

19. A method for separating particles in a fluid medium based on a difference in settling velocity consisting of:

introducing particles and fluid medium tangentially into an upper portion of a separation zone;

reducing flow velocity of said particles and fluid medium;

dispersing said particles and fluid medium across said separation zone;

introducing fluidization water to a lower portion of said separation zone;

removing separated fine particles at said upper portion of said separation zone;

removing separated coarse particles at said lower portion of said separation zone.

20. A slurry feed transition structure for a cross-flowing hindered bed separator comprising:

a stilling well accessible from above by a slurry flow;

an impact plate forming a bottom of said stilling well;

a first adjustable side wall forming at least one portion of a first side of said stilling well;

a first adjustable baffle plate extending generally parallel to and generally coextensive with said first adjustable side wall whereby said slurry flow entering said stilling well and descending toward said impact plate will then proceed under said first adjustable side wall and exit said first adjustable baffle plate.

21. The slurry feed transition structure recited in claim 20 wherein said first adjustable side wall comprises more than one side wall portion.

22. The slurry feed transition structure recited in claim 20 wherein said first adjustable side wall is adjustable upwardly and downwardly.

23. The slurry feed transition structure recited in claim 20 wherein said impact plate has a first flange extending upwardly at the inner end thereof whereby said slurry flow proceeds under said first adjustable side wall, over said first flange, and under said first adjustable baffle plate into a separation chamber.

24. The slurry feed transition structure recited in claim 20 wherein said first adjustable baffle plate comprises more than one baffle plate portion.

25. The slurry feed transition structure recited in claim 20 wherein said first adjustable baffle plate is rotatably supported at the upper end thereof and is positionable through a range of rotation.

26. The slurry feed transition structure recited in claim 20 further comprising a second adjustable side wall forming at least one portion of a second side of said stilling well whereby said slurry flow entering said stilling well and descending toward said impact plate will then proceed in part under said first adjustable side wall and in part under said second adjustable side wall.

27. The slurry feed transition structure recited in claim 20 wherein said first adjustable side wall and said first baffle plate form a first baffle chamber;

a second adjustable side wall and a second baffle plate form a second baffle chamber;

said impact plate has a first flange extending upwardly in said first baffle chamber and a second flange upwardly extending in said second baffle chamber whereby said slurry flow must pass over said flanges as said slurry flow passes through said first and said second baffle chambers.

28. A cross-flowing hindered-bed separator comprising:

a separator body having a top end and a bottom end and enclosing an upper portion and a lower portion;

a slurry feed transition box adjacent said top end of said separator body;

a feed introducer between said transition box and said separator body that directs said slurry horizontally across the upper surface of said separator; and, an overflow launder adjacent said top end of said separator body.

29. A cross-flowing hindered-bed separator comprising:

separator body having a top end and a bottom end enclosing an upper portion and a lower portion;

a dispersion plate extending generally across said separator body between said upper portion and said lower portion;

said dispersion plate having spaced holes therethrough;

teeter water entering said separator body below said dispersion plate; and, said dispersion plate distributes said teeter water across said separator body as said teeter water moves upwardly.

30. A method for separating particles in a fluid medium based on differences in settling velocity or density consisting of:

introducing particles and fluid medium horizontally across the upper surface of a separation zone;

reducing flow velocity of said particles and fluid medium;

dispersing said particles and fluid medium across said separation zone;

introducing fluidization water to a lower portion of said separation zone;

removing separated fine particles at said upper portion of said separation zone; and, removing separated coarse particles at said lower portion of said separation zone.

* * * * *